US009006601B2

(12) United States Patent
Zhou et al.

(10) Patent No.: US 9,006,601 B2
(45) Date of Patent: Apr. 14, 2015

(54) ARC CHAMBER FOR BI-DIRECTIONAL DC

(71) Applicant: Eaton Corporation, Cleveland, OH (US)

(72) Inventors: Xin Zhou, Wexford, PA (US); Richard Paul Malingowski, McDonald, PA (US); Kelly Julia McCarthy, Pittsburgh, PA (US); David E. Little, Midland, PA (US)

(73) Assignee: Eaton Corporation, Cleveland, OH (US)

( * ) Notice: Subject to any disclaimer, the term of this patent is extended or adjusted under 35 U.S.C. 154(b) by 146 days.

(21) Appl. No.: 13/798,222

(22) Filed: Mar. 13, 2013

(65) Prior Publication Data

US 2014/0263188 A1 Sep. 18, 2014

(51) Int. Cl.

| | |
|---|---|
| ***H01H 33/08*** | (2006.01) |
| ***H01H 33/22*** | (2006.01) |
| ***H01H 9/34*** | (2006.01) |
| ***H01H 9/44*** | (2006.01) |
| ***H01H 9/36*** | (2006.01) |
| ***H01H 9/46*** | (2006.01) |
| ***H01H 33/20*** | (2006.01) |

(52) U.S. Cl.

CPC ..... *H01H 33/08* (2013.01); *H01H 33/20* (2013.01); *H01H 9/346* (2013.01); *H01H 9/362* (2013.01); *H01H 9/443* (2013.01); *H01H 9/46* (2013.01)

(58) Field of Classification Search

CPC ..... H01H 33/08; H01H 33/20; H01H 33/182; H01H 9/30; H01H 9/346

USPC ..... 218/22, 23, 46, 81, 103, 104, 139, 148; 335/35, 92, 136, 177, 201; 200/10, 401

See application file for complete search history.

(56) References Cited

U.S. PATENT DOCUMENTS

| | | | | |
|---|---|---|---|---|
| 4,375,021 | A | 2/1983 | Pardini et al. | |
| 4,743,720 | A | 5/1988 | Takeuchi et al. | |
| 5,004,874 | A | 4/1991 | Theisen et al. | |
| 5,130,504 | A | 7/1992 | Moldovan et al. | |
| 6,008,459 | A * | 12/1999 | Faber et al. | 200/401 |
| 7,541,902 | B2 | 6/2009 | Domejean et al. | |
| 7,679,020 | B2 | 3/2010 | Schulz et al. | |

(Continued)

FOREIGN PATENT DOCUMENTS

| | | |
|---|---|---|
| DE | 1007409 | 5/1957 |
| DE | 11 04 019 B | 4/1961 |

(Continued)

OTHER PUBLICATIONS

Siemens Industry, Inc., "Heavy Duty Photovoltaic Disconnect Switches," www.usa.siemens.com/switches, 2010, 4 pp.

(Continued)

*Primary Examiner* — Renee Luebke
*Assistant Examiner* — William Bolton
(74) *Attorney, Agent, or Firm* — Eckert Seamans Cherin & Mellott, LLC; David C. Jenkins

(57) ABSTRACT

A circuit breaker including a pair of separable contacts and an arc chamber is provided. The separable contacts include a fixed contact having an upper surface. The arc chamber includes magnetic members disposed on either side of the separable contacts. The magnetic members have a lower surface below the fixed contact upper surface.

18 Claims, 7 Drawing Sheets

(56) References Cited

U.S. PATENT DOCUMENTS

| | | | | |
|---|---|---|---|---|
| 7,839,243 | B1 | 11/2010 | Chen et al. | |
| 8,222,983 | B2 * | 7/2012 | Zhou et al. | 335/201 |
| 8,772,665 | B2 * | 7/2014 | An | 218/34 |

FOREIGN PATENT DOCUMENTS

| | | | |
|---|---|---|---|
| DE | 1140997 | | 12/1962 |
| DE | 1246851 | | 8/1967 |
| DE | 33 37 562 | A1 | 4/1985 |
| DE | 202005007878 | | 9/2006 |
| EP | 2 463 880 | A1 | 6/2012 |

OTHER PUBLICATIONS

Tyco Electronics, Kilovac EV250-1A & 1B—400 Amps ("Czonka II EVX"), www.tycoelectronics.com, 2010, pp. 16 and 19.

European Patent Office, "International Search Report and Written Opinion", Apr. 14, 2014, 11 pp.

* cited by examiner

ARC CHAMBER FOR BI-DIRECTIONAL DC

BACKGROUND OF THE INVENTION

1. Field of the Invention

The disclosed concept pertains generally to electrical switching apparatus and, more particularly, to direct current electrical switching apparatus, such as, for example, direct current circuit breakers. The disclosed concept further pertains to a direct current arc chamber including a magnetic member having a lower surface disposed below the fixed contact.

2. Background Information

Electrical switching apparatus employing separable contacts exposed to air can be structured to open a power circuit carrying appreciable current. These electrical switching apparatus, such as, for instance, circuit breakers, typically experience arcing as the contacts separate and commonly incorporate arc chambers, such as arc chamber assemblies, to help extinguish the arc. Such arc chamber assemblies typically comprise a plurality of electrically conductive plates held in spaced relation around the separable contacts by an electrically insulative housing. The arc transfers to the arc plates where it is stretched and cooled until extinguished.

Known molded case circuit breakers (MCCBs) are not specifically designed for use in direct current (DC) applications. When known alternating current (AC) MCCBs are sought to be applied in DC applications, multiple poles are electrically connected in series to achieve the required interruption or switching performance based upon the desired system DC voltage and system DC current.

One of the challenges in DC current interruption/switching, especially at a relatively low DC current, is to drive the arc into the arc interruption chamber. Known DC electrical switching apparatus employ permanent magnets to drive the arc into arc splitting plates. Known problems associated with such permanent magnets in known DC electrical switching apparatus include unidirectional operation of the DC electrical switching apparatus, and two separate arc chambers each including a plurality of arc plates and a set of contacts must be employed to provide bi-directional operation. These problems make it very difficult to implement a permanent magnet design for a typical DC single-pole MCCB without a significant increase in size and cost.

An electrical switching apparatus with a permanent magnet arrangement and single break operation may be used to achieve bi-directional DC switching and interruption. For example, two permanent magnet plates employed along both sides of a single arc chamber include a single set of a plurality of arc plates and a permanent magnet or ferromagnetic center barrier to provide a dual arc chamber structure. The resulting magnetic field drives the arc into one side of the dual arc chamber structure and splits the arc accordingly depending upon the direction of the DC current. Such a single direct current arc chamber includes a ferromagnetic base having a first end and an opposite second end; a first ferromagnetic side member disposed from the first end of the ferromagnetic base; a second ferromagnetic side member disposed from the opposite second end of the ferromagnetic base; a third ferromagnetic member disposed from the ferromagnetic base intermediate the first and second ferromagnetic side members; a first permanent magnet having a first magnetic polarity disposed on the first ferromagnetic side member and facing the third ferromagnetic member; and a second permanent magnet having the first magnetic polarity disposed on the second ferromagnetic side member and facing the third ferromagnetic member.

Such an arc chamber can still be improved. That is, as the arc created during the separation of the contacts moves from the contacts to the arc plates, the arc may impinge upon the housing for the magnetic members disposed on either side of the contacts. Further, the arc may experience a fringing effect that can impede the progress of the arc. That is, if the lower edges of the permanent magnets are at or near the fixed contact surface level, the magnetic field generated by the permanent magnets close to the fixed contact region is either significantly reduced or reverses its direction. This reversed magnetic field will drive the arc in an opposite direction away from the arc interruption chamber. The reduction or reversion of the magnetic field near the edge of a permanent magnet is called the fringing effect.

There is, therefore, a need for an improved arc chamber configured to control the path of travel of the arc. There is a further need for such an arc chamber to be compatible with existing circuit breaker housings.

SUMMARY OF THE INVENTION

These needs, and others, are met by at least one embodiment of the disclosed and claimed concept which provides an arc chamber wherein the magnetic member disposed on either side of the separable contacts have a lower surface below the fixed contact upper surface. In this configuration, the fringing effect that can impede the progress of the arc is eliminated. Further, at least one embodiment of the disclosed and claimed concept provides an arc chamber wherein an arc runner, i.e. an additional conductive member, is disposed between the separable contacts and the arc plates. The arc runner is wider than the separable contacts. This provides a larger surface for the arc to move from the contacts to the arc runner and allow the arc to engage the arc plates.

The disclosed concept relies upon the configuration of the noted elements, i.e. the size, shape, and position of the noted elements, to solve the stated problems.

BRIEF DESCRIPTION OF THE DRAWINGS

A full understanding of the disclosed and claimed concept can be gained from the following description of the preferred embodiments when read in conjunction with the accompanying drawings in which:

DESCRIPTION OF THE PREFERRED EMBODIMENTS

Figure 1:
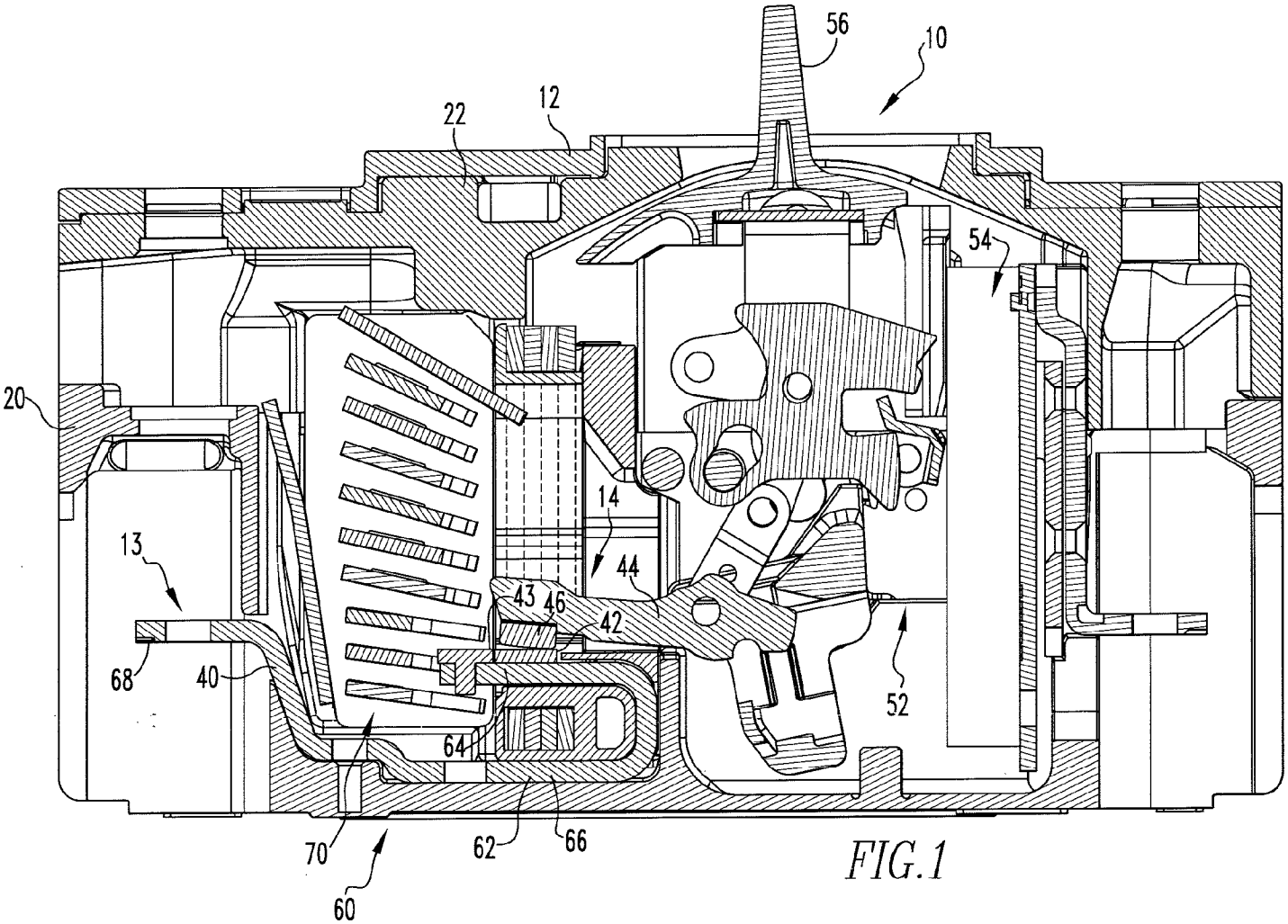
FIG. 1 is a cross-sectional side view of a circuit breaker.

As used herein, "coupled" means a link between two or more elements, whether direct or indirect, so long as a link occurs. An object resting on another object held in place only by gravity is not "coupled" to the lower object unless the upper object is otherwise maintained substantially in place. That is, for example, a book on a table is not coupled thereto, but a book glued to a table is coupled thereto.

As used herein, "directly coupled" means that two elements are directly in contact with each other.

As used herein, "fixedly coupled" or "fixed" means that two components are coupled so as to move as one while maintaining a constant orientation relative to each other. Similarly, two or more elements disposed in a "fixed relationship" means that two components maintain a substantially constant orientation relative to each other.

As used herein, the word "unitary" means a component is created as a single piece or unit. That is, a component that includes pieces that are created separately and then coupled together as a unit is not a "unitary" component or body.

As used herein, "associated" means that the identified components are related to each other, contact each other, and/or interact with each other. For example, an automobile has four tires and four hubs, each hub is "associated" with a specific tire. As a further example, a circuit breaker may include a number of pair of separable contacts; each pair of separable contacts may interact with similar elements, such as but not limited to an arc chamber. Thus, each pair of separable contacts has an "associated" arc chamber.

As used herein, "engage," when used in reference to gears or other components having teeth, means that the teeth of the gears interface with each other and the rotation of one gear causes the other gear or other component to rotate/move as well. As used herein, "engage," when used in reference to components not having teeth means that the components are biased against each other.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As used herein, "correspond" indicates that two structural components are similar in size, shape or function. With reference to one component being inserted into another component or into an opening in the other component, "corresponding" means components are sized to engage or contact each other with a minimum amount of friction. Thus, an opening which corresponds to a member is sized slightly larger than the member so that the member can pass through the opening with a minimum amount of friction. This definition is modified if the two components are said to fit "snugly" together. In that situation, the difference between the size of the components is even smaller whereby the amount of friction increases. If one or more components are resilient, a "snugly corresponding" shape may include one component, e.g. the component defining the opening being smaller than the component inserted therein. Further, as used herein, "loosely correspond" means that a slot or opening is sized to be larger than an element disposed therein. This means that the increased size of the slot or opening is intentional and is more than a manufacturing tolerance.

As used herein, "magnetic members" means at least one member is a permanent magnet and another member may be ferromagnetic. That is, a plurality of "magnetic members" may include all permanent magnets or a combination of at least one permanent magnet and other ferromagnetic members.

As used herein, "at" means on or near.

Figure 2:
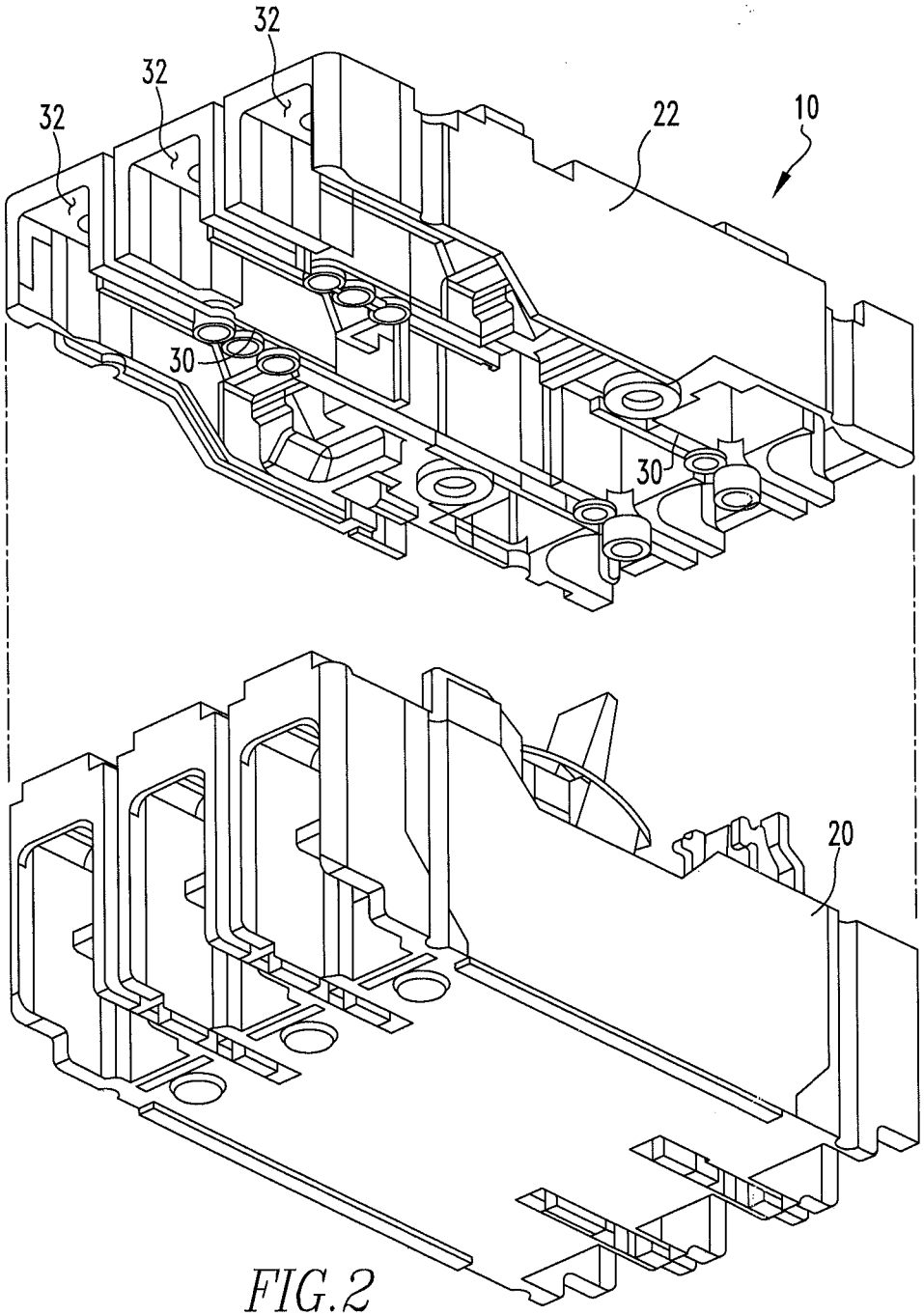
FIG. 2 is an isometric exploded upward view of a circuit breaker.
Figure 3:
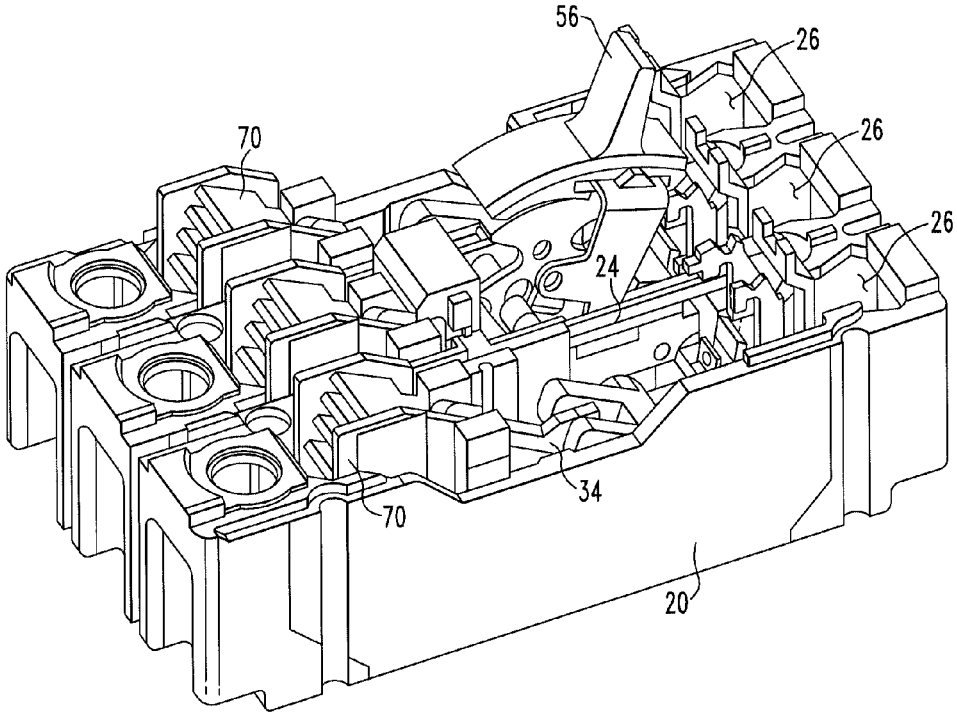
FIG. 3 is an isometric downward view of a circuit breaker.

As shown in FIG. 1, a circuit breaker 10 includes a housing assembly 12 and a number of conductor assemblies 13 each including a pair of separable contacts 14. Typically, there is one conductor assembly 13 for each pole of the circuit breaker 10. An exemplary three-pole circuit breaker 10 is shown. The housing assembly 12 includes an elongated base portion 20 which is coupled to an elongated primary cover 22 (FIG. 2). As shown in FIG. 3, the base portion 20 includes a plurality of internal walls 24 defining number of elongated cavities 26. In an exemplary embodiment, there is one cavity 26 for each pole of the circuit breaker 10. As shown in FIG. 2, the primary cover 22 also includes a plurality of internal walls 30 which also define a number of elongated cavities 32. As noted above, in a three pole circuit breaker 10 there are three base portion cavities 26 and three primary cover cavities 32. The base portion cavities 26 and primary cover cavities 32 extend generally parallel to each other and parallel to a longitudinal axis of the housing assembly 12. The base portion cavities 26 generally align with the primary cover cavities 32 so that when the primary cover 22 is coupled to the base portion 20, the base portion cavities 26 and the primary cover cavities 32 define a number of contact chambers 34, and in an exemplary embodiment with a three-pole circuit breaker 10, three contact chambers 34.

Each conductor assembly 13 includes substantially similar elements and, as such, only one conductor assembly 13 will be described. It is understood that the elements described are associated with a single conductor assembly 13 and each conductor assembly 13 has a similar set of associated elements. Each conductor assembly 13 includes an elongated fixed conductor 40, a fixed contact 42, a movable conductor 44, and a movable contact 46. The fixed contact 42 is coupled to, and in an exemplary embodiment directly coupled to, as well as in electrical communication with, the fixed conductor 40. In another exemplary embodiment, the fixed contact 42 is unitary with, the fixed conductor 40. Each fixed contact 42 has a generally planar upper surface 43 and a width (discussed below). In an exemplary embodiment, the movable contact 46 engages the fixed contact upper surface 43 when in the second position.

The movable contact 46 is coupled to, and in an exemplary embodiment directly coupled to, as well as in electrical communication with, the movable conductor 44. In an exemplary embodiment, the movable contact 46 is unitary with the movable conductor 44. The movable contact 46, and more specifically, the movable conductor 44, is coupled to an operating mechanism 52. The operating mechanism 52 is structured to move the movable contact 46 between a first, open position wherein the contacts 14 are separated, and a second, closed position wherein the contacts 14 are in electrical communication. The operating mechanism 52 is coupled to a trip mechanism 54 (shown schematically) and a handle 56. Thus, the operating mechanism 52 may be actuated manually by the handle 56, or, actuated in response to an over-current condition by the trip mechanism 54.

Figure 4:
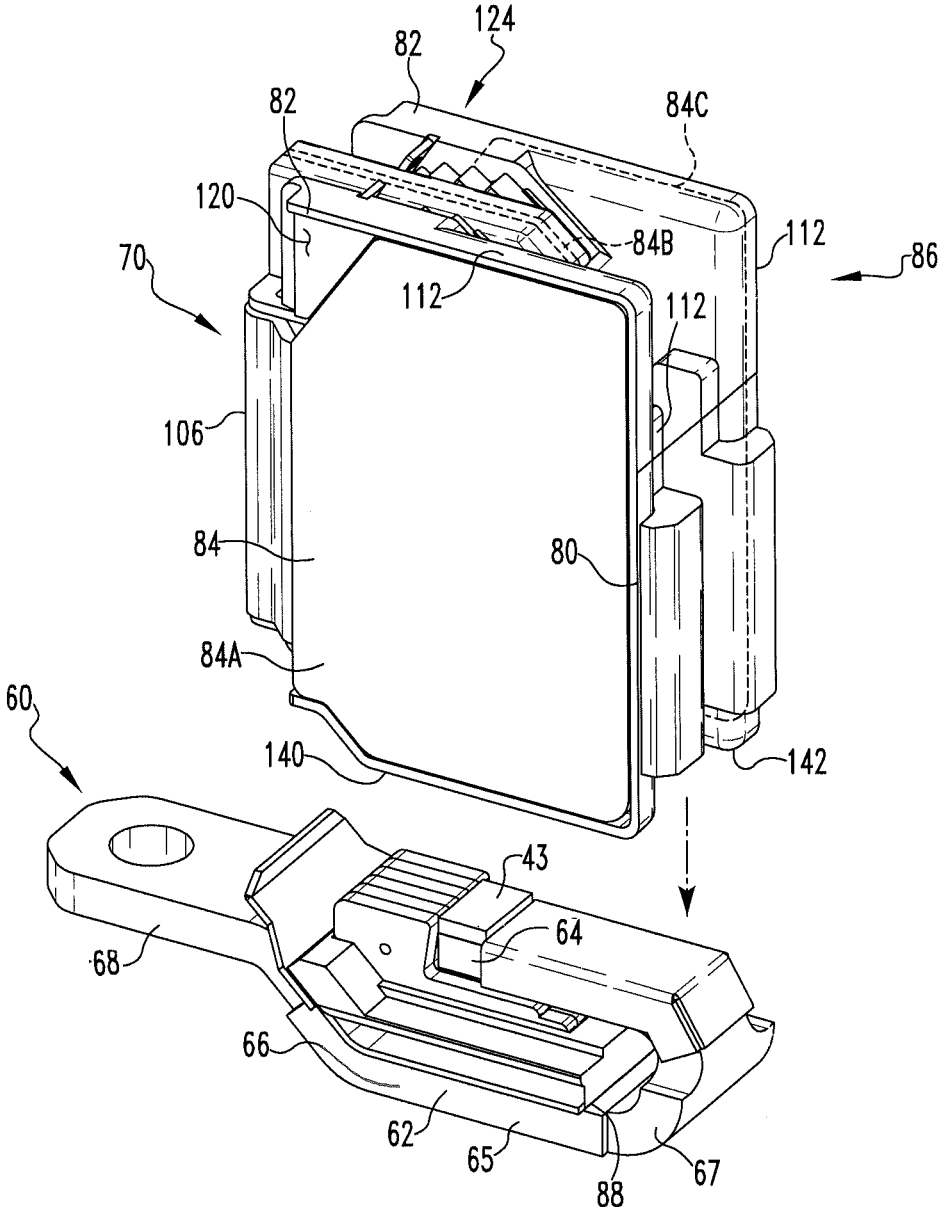
FIG. 4 is an exploded isometric view of a fixed contact assembly.

The fixed conductor 40 and fixed contact 42 are also part of a fixed contact assembly 60, shown in FIG. 4. Again, it is understood that the elements described are associated with a fixed contact assembly 60 and each fixed contact assembly 60 has a similar set of associated elements. The fixed contact assembly 60 further includes an arc chamber assembly 70. The fixed conductor 40 is, in an exemplary embodiment, an elongated body 62 including a first end 64, a medial portion 66, and a second end 68. The fixed conductor body first end 64 is curled over the fixed conductor body medial portion 66 with a space or gap between the fixed conductor body first end 64 and the fixed conductor body medial portion 66. That is, the fixed conductor body medial portion 66 includes a planar portion 65 and an arcuate portion 67. The arcuate portion 67 extends over an arc of at least ninety degrees and, as shown, in one embodiment over an arc of about one-hundred and eighty degrees. As shown, in one embodiment the fixed conductor body first end 64 is a planar member that extends in a plane generally parallel to the fixed conductor body medial portion planar portion 65.

Each conductor assembly 13 has an associated arc chamber assembly 70. Thus, in an exemplary embodiment having three conductor assemblies 13, there are three arc chamber assemblies 70 with one arc chamber assembly 70 associated with each conductor assembly 13. As with the conductor assemblies 13, the arc chamber assemblies 70 are substantially similar and only one will be described. Each arc chamber assembly 70 includes a housing assembly 80 and a number of conductive members 130, discussed below. The housing assembly 80 includes a number of non-conductive support members 82 and number of magnetic members 84.

Figure 5:
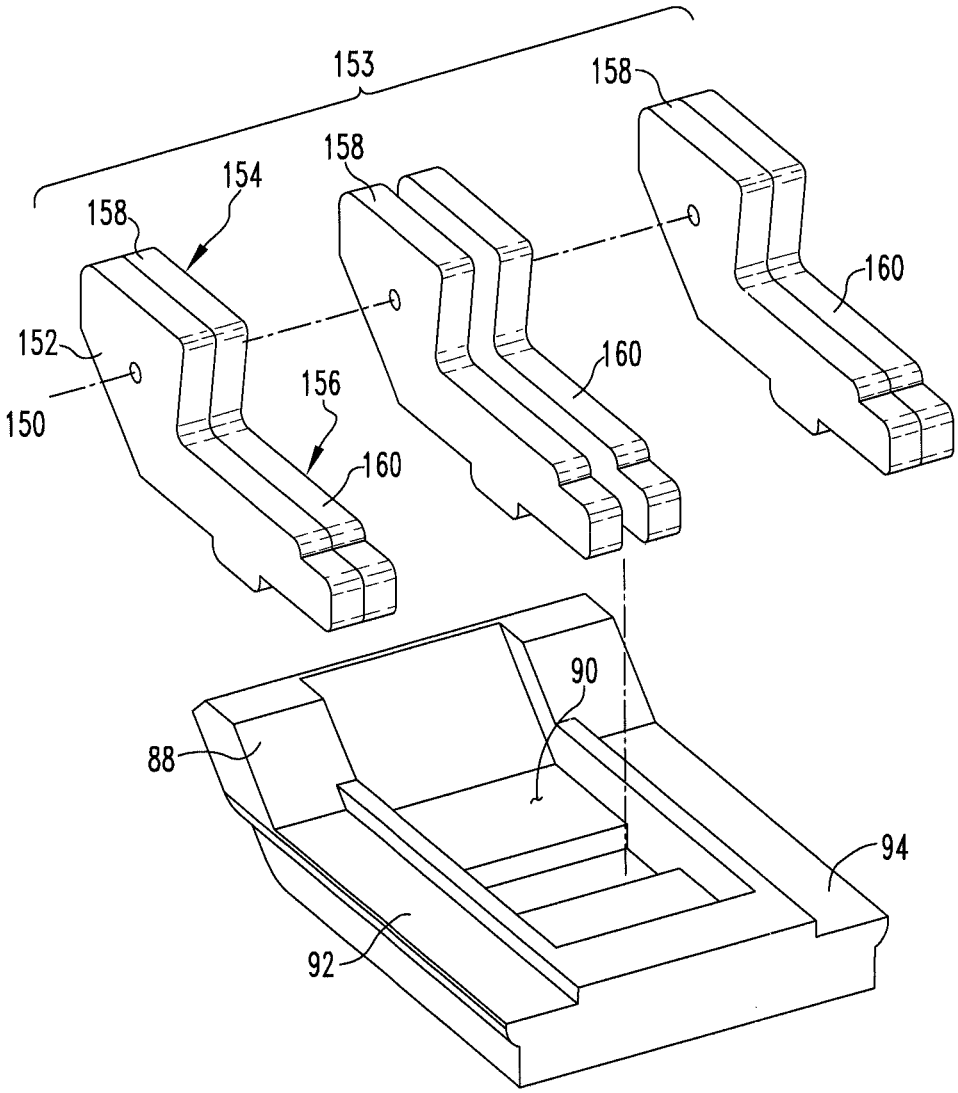
FIG. 5 is a detail isomeric view of a lower support assembly.

More specifically, the housing assembly 80 includes an upper support assembly 86 and a lower support assembly 88. As shown in FIG. 5, The lower support assembly 88 is generally planar and sized to fit in the gap between the fixed conductor body first end 64 and the fixed conductor body medial portion 66. The lower support assembly 88 defines a pocket 90 sized to accommodate or correspond to the arc runner conductive plates 152, discussed below. The lower support assembly 88 includes two lateral side upper surfaces 92, 94 that are generally planar and extend generally horizontally.

Figure 6:
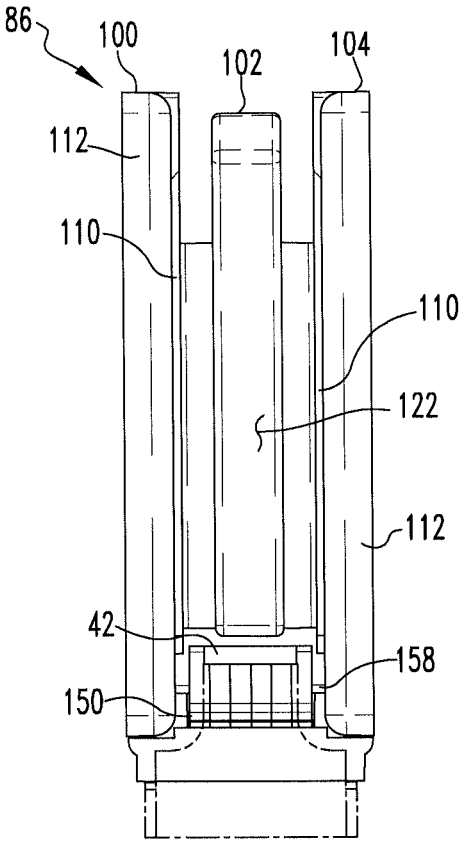
FIG. 6 is an end view of a fixed contact assembly.
Figure 7:
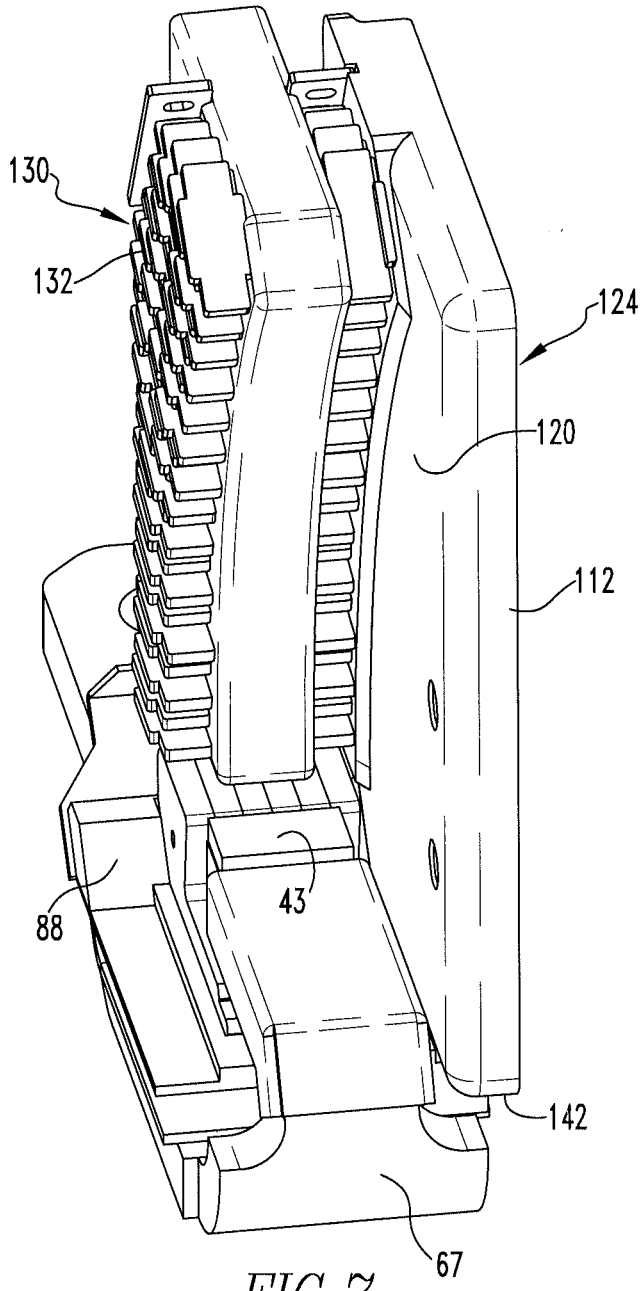
FIG. 7 is a partial isometric view of a fixed contact assembly.

The upper support assembly 86, shown in FIGS. 4, 6 and 7, in an exemplary embodiment, includes three support members; a first lateral support member 100, a medial support member 102, and a second lateral support member 104. Each support member 100, 102, 104 is structured to support a magnetic member 84. In one exemplary embodiment, the magnetic members 84 are permanent magnets. In another exemplary embodiment, the magnetic members 84 supported by the lateral support members 100, 104 are permanent magnets and the magnetic members 84 supported by the medial support member 102 is ferromagnetic. The three support members 100, 102, 104 are generally planar and disposed in a plane extending generally vertically and parallel to the longitudinal axis of the associated conductor assembly 13, i.e. the elongated fixed conductor 40. The support members 100, 102, 104 are made from a non-conductive material. In an exemplary embodiment, the upper support assembly 86 has a generally E-shaped cross-section (when viewed as a top plan view) including a base member 106 (FIG. 4) from which the support members 100, 102, 104 extend. That is, the base member 106 extends in a vertical plane generally perpendicular to the support members 100, 102, 104. As shown in FIG. 4, the base member 106 may have a shorter height than the other support members 100, 102, 104. Each support member 100, 102, 104 defines a pocket sized to correspond to the associated magnetic member 84A, 84B, 84C. That is, as described below, a magnetic member 84 is disposed within each support member 100, 102, 104 pocket, thus each magnetic member 84 is associated with a specific support member 100, 102, 104.

That is, in an exemplary embodiment, each support member 100, 102, 104 includes a number of planar members 110 and a number of depending sidewalls 112. The depending sidewalls extend generally perpendicular to the plain of the planar member 110. The lateral support members 100, 104 are disposed adjacent a base portion internal wall 24. That is, the base portion internal wall 24 is disposed generally parallel to, and spaced from, a planar member 110. Thus, the planar member 110, the sidewalls 112 and the base portion internal wall 24 of the support members 100, 102, 104, define lateral pockets 120, 124 respectively. The medial support member 102 includes two planar members 110 with a depending sidewall 112 extending therebetween. The two planar members 110 and depending sidewalls 112 define a medial pocket 122. In an exemplary embodiment, the planar member 110 and the sidewalls 112 has a thickness of between about 0.030 and 0.070 inch, and in an exemplary embodiment, about 0.060 inch. In this configuration, the thickness of the support members 100, 102, 104 have limited effect on the electromagnetic characteristics of the magnetic members 84 due to their permeability and their thickness.

The number of magnetic members 84 includes, in an exemplary embodiment, three magnetic members a first lateral magnetic member 84A, a medial magnetic member 84B, and a second lateral magnetic member 84C. Each magnetic member 84A, 84B, 84C is generally planar. Further, each lateral magnetic member 84A, 84C has a generally horizontal lower surface 140, 144 respectively. Each magnetic member 84A, 84B, 84C is disposed within a support member 100, 102, 104, respectively. That is, each magnetic member 84A, 84B, 84C is sized to correspond to a support member pocket 120, 122, 124, respectively. When the magnetic members 84A, 84B, 84C are disposed in their associated pocket, each magnetic member 84A, 84B, 84C extends in a generally vertical and longitudinal plane. In this configuration, the first lateral support member 100 is spaced from the medial support member 102, and, the medial support member 102 is spaced from the second lateral support member 104.

The arc chamber assembly conductive members 130 are disposed in the space between the first lateral support member 100 and the medial support member 102, and, the space between the medial support member 102 and the second lateral support member 104. That is, as shown in FIG. 7, the arc chamber assembly conductive members 130 includes a number of planar bodies 132 sized to correspond to the space between the first lateral support member 100 and the medial support member 102, and, the space between the medial support member 102 and the second lateral support member 104. The arc chamber assembly conductive members planar bodies 132 are disposed in a generally parallel, or slightly fanned out arrangement, and spaced relation to each other.

The arc chamber assembly 70 is then disposed over the fixed conductor body medial portion 66 and adjacent, that is on either side of, the fixed conductor body first end 64. Arc chamber assembly 70 is structured to split and interrupt an arc created by separation of the contacts 14. Arc chamber assembly 70 is sized to correspond to, i.e. fit within, a contact chamber 34. That is, the spacing between the arc chamber assembly first lateral support member 100 and the arc chamber assembly second lateral support planar member 104 generally corresponds to the width of a contact chamber 34.

Figure 8:
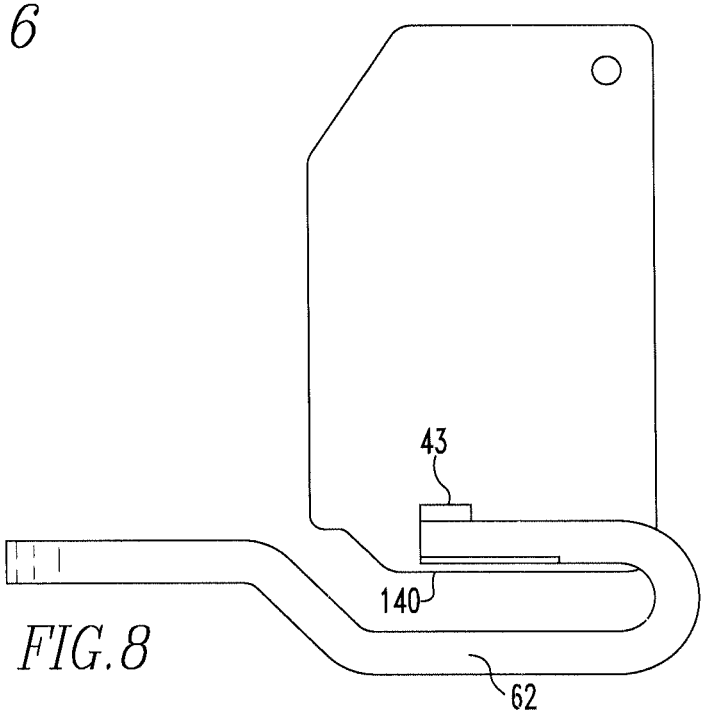
FIG. 8 is a side view of a fixed contact assembly.

When placed in a contact chamber 34 the first and second lateral magnetic members 84A, 84C are disposed on opposing lateral sides of a pair of separable contacts 14. The lateral support members 100, 104 are configured to position each magnetic member lower surface 140, 144 below the associated fixed contact upper surface 43, as shown in FIG. 8. More specifically, each magnetic member lower surface 140, 142 is spaced between about $^{34}/_{128}$ inch and $^{43}/_{128}$ inch below the fixed contact upper surface 43 and, in an exemplary embodiment, each magnetic member lower surface 140, 142 is spaced about $^{39}/_{128}$ inch below the fixed contact upper surface 43. Further, in this configuration, the inner side of the first lateral support member 100 and the inner side of the second lateral support member 104 are laterally spaced from the fixed contact upper surface 43. That is, as shown in FIG. 6, the inner side of the first lateral support member 100 and the inner side of the second lateral support member 104 are laterally spaced from the lateral edges of the fixed contact 42. In one embodiment, each lateral magnetic member 84A, 84C is laterally spaced between about 8/128 inch and 19/128 inch from the fixed contact 42. That is, the distance from the support members 100, 104 to the fixed contact 42 is between about 8/128 inch and 19/128 inch.

The arc chamber assembly conductive members 130 further include an arc runner assembly 150, as shown best in FIG. 5. The arc runner assembly 150 includes a number of conductive plates 152. In an exemplary embodiment, the arc runner assembly plates 152 are disposed in a stack 153. That is, as used herein, a "stack" includes multiple planar members having the same general shape, disposed in an aligned configuration and contact with each other. That is, the planar members are disposed in a configuration wherein their perimeters are generally aligned. In an exemplary embodiment, each arc runner assembly plate 152 includes a thick portion 154 and a thin portion 156. Each of the arc runner assembly plate thick portion 154 and arc runner assembly plate thin portion 156 has an upper surface 158, 160, respectively. The thin portion 156 has a height sized to correspond to the lower support assembly pocket 90. Further, the arc runner assembly plate stack 153 has a width sized to correspond to the lower support assembly pocket 90. In an embodiment with a single arc runner assembly plate 152, the single arc runner assembly plate 152 has a width sized to correspond to the lower support assembly pocket 90.

The arc runner assembly plate stack 153 is disposed within the lower support assembly pocket 90. As described above, the lower support assembly 88 is sized to fit in the gap between the fixed conductor body first end 64 and the fixed conductor body medial portion 66. When the lower support assembly 88 is disposed in the gap between the fixed conductor body first end 64 and the fixed conductor body medial portion 66, the number of conductive plates 152 are coupled to, and in electrical communication with, the fixed conductor 40. In an exemplary embodiment, the arc runner assembly plate thin portion upper surface 160 is directly coupled to the fixed conductor body first end 64. In this configuration, the arc runner assembly plate thick portion upper surface 158 is positioned to be generally parallel to the fixed contact generally planar upper surface 43. In this configuration, an arc created during the separation of the contacts 14 may travel over the fixed contact generally planar upper surface 43 and onto the arc runner assembly plate thick portion upper surface 158.

Further, the arc runner assembly plate stack 153 has a width, or in an embodiment with a single arc runner assembly plate 152, the single arc runner assembly plate 152 has a width, hereinafter either shall be identified as the "arc runner assembly width." The arc runner assembly 150 width is greater than the width of the fixed contact 42 and the width of the medial support member 102. In one embodiment, the fixed contact 42 has a width of about 45/128 inch and the arc runner assembly 150 has a width between about 55/128 inch and 65/128 inch. In an exemplary embodiment, the medial support member 102 has a width between about 0.225 inch and 0.275 inch. In an exemplary embodiment, the arc runner assembly 150 has a width of about 60/128 inch.

While specific embodiments of the disclosed and claimed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed and claimed concept which is to be given the full breadth of the claims appended and any and all equivalents thereof.

What is claimed is:

1. An arc chamber assembly for a direct current circuit breaker, said circuit breaker including a number of pairs of separable contacts, each pair of separable contacts including a fixed contact having a generally planar upper surface, wherein said fixed contact has a width, said arc chamber comprising:

a housing assembly and a number of conductive members;

said housing assembly including a number of support members and a number of magnetic members, each magnetic each member having a generally horizontal lower surface;

each magnetic member coupled to a support member;

wherein said support members position each said magnetic member lower surface below said fixed contact upper surface;

said number of conductive members includes an arc runner assembly;

said arc runner assembly includes a number of conductive plates;

said arc runner conductive plates disposed adjacent to, and in electrical communication with, said fixed contact; and said arc runner assembly has a width that is greater than the width of said fixed contact.

2. The arc chamber assembly of claim 1 wherein:

said number of magnetic members includes two magnetic members; and wherein said magnetic members are disposed on opposing lateral sides of a pair of separable contacts.

3. The arc chamber assembly of claim 2 wherein:

each magnetic member is a planar member; and each said magnetic member extends in a generally vertical and longitudinal plane.

4. The arc chamber assembly of claim 3 wherein said fixed contact has a width and wherein:

each said magnetic member disposed immediately adjacent a lateral side of said arc runner assembly and being spaced from said fixed contact.

5. The arc chamber assembly of claim 4 wherein each said magnetic member is laterally spaced between about 8/128 inch and 19/128 inch from said fixed contact.

6. The arc chamber assembly of claim 1 wherein each said magnetic member lower surface is spaced between about 34/128 inch and 43/128 inch below said fixed contact upper surface.

7. The arc chamber assembly of claim 6 wherein said fixed contact has a width of about 45/128 inch and wherein said arc runner assembly has a width between about 55/128 inch and 65/128 inch.

8. The arc chamber assembly of claim 6 wherein said fixed contact has a width of about 45/128 inch and wherein said arc runner assembly has a width of about 60/128 inch.

9. The arc chamber assembly of claim 1 wherein each said magnetic member lower surface is spaced about 39/128 inch below said fixed contact upper surface.

10. A circuit breaker assembly comprising:

a housing assembly defining a number of contact chambers;

a number of conductor assemblies each having a pair of separable contacts;

each conductor assembly further including a fixed conductor, and an arc chamber assembly;

each said fixed conductor including an elongated body with a first end and a medial portion said fixed conductor body end curled over said fixed conductor body medial portion;

wherein each said fixed conductor body first end is a fixed contact icluding an upper surface;

each said arc chamber assembly includes a housing assembly and a number of conductive members;

each said arc chamber housing assembly including a number of support members and a number of magnetic members each magnetic member havinig generally horizontal lower surface;

each magnetic member coupled to a support member;

wherein each said support members position the associated magnetic members' lower surface below the associated fixed contact upper surface;

each said fixed contact has a width;

said number of conductive members includes an arc runner assembly associated with each pair of separable contacts;

each said arc runner assembly includes a number of conductive members;

said arc runner conductive members disposed below, and in electrical communication with, said associated fixed contact; and each said arc runner assembly has a width that is greater than the width of said associated fixed contact.

11. The circuit breaker assembly of claim 10 wherein:

said number of magnetic members includes two magnetic members associated with each pair of separable contacts; and wherein said magnetic members are disposed on opposing lateral sides of the associated pair of separable contacts.

12. The circuit breaker assembly of claim 11 wherein:

each magnetic member is a planar member; and each said magnetic member extends in a generally vertical and longitudinal plane.

13. The circuit breaker assembly of claim 12 wherein:

each said magnetic member disposed immediately adjacent a lateral side of said arc runner assembly and being spaced from said associated fixed contact.

14. The circuit breaker assembly of claim 13 wherein each said magnetic member is spaced between about $^{8}/_{128}$ inch and $^{19}/_{128}$ inch from said associated fixed contact.

15. The circuit breaker assembly of claim 10 wherein each said magnetic member lower surface is spaced between about $^{34}/_{128}$ inch and $^{43}/_{128}$ inch below said associated fixed contact upper surface.

16. The circuit breaker assembly of claim 15 wherein each said fixed contact has a width of about $^{45}/_{128}$ inch and wherein each said arc runner assembly has a width between about $^{55}/_{128}$ inch and $^{65}/_{128}$ inch.

17. The circuit breaker assembly of claim 15 wherein said each fixed contact has a width of about $^{45}/_{128}$ inch and wherein each said arc runner assembly has a width of about $^{60}/_{128}$ inch.

18. The circuit breaker assembly of claim 10 wherein each said magnetic member lower surface is spaced about $^{39}/_{128}$ inch below said associated fixed contact upper surface.

* * * * *